US005363511A

United States Patent [19]

Brewer

[11] Patent Number: 5,363,511

[45] Date of Patent: Nov. 15, 1994

[54] PANTIES AND A METHOD OF FABRICATING THE SAME

[76] Inventor: Christine G. Brewer, 3711-40th Street SW., Calgary, Alberta, Canada, T3E 3K4

[21] Appl. No.: 121,577

[22] Filed: Sep. 16, 1993

[51] Int. Cl.[5] ..... A41B 9/00; A41B 9/14

[52] U.S. Cl. ..... 2/406; 2/400; 450/94; 450/156

[58] Field of Search ..... 2/67, 69, 73, 105, 106, 2/115, 243.1, 400, 403, 406, 401, 402, 404, 405, 407, 408, 409; 450/107, 115, 116, 117, 119, 122, 124, 125, 126, 127, 132, 94, 155, 156; 604/385.1, 392, 396, 385.2

[56] References Cited

U.S. PATENT DOCUMENTS

| | | | |
|---|---|---|---|
| 2,091,018 | 8/1937 | Sivyer | 2/224 |
| 2,431,571 | 11/1947 | Lehr | 2/406 |
| 2,763,008 | 9/1956 | Rosenthal | 450/122 X |
| 3,142,300 | 7/1964 | Erteszek | 450/124 X |
| 3,654,634 | 4/1972 | Torres | 2/403 |
| 4,028,740 | 6/1977 | Luerken | 2/67 |
| 4,121,305 | 10/1978 | Kolker | 2/406 |
| 4,355,425 | 10/1982 | Jones et al. | 2/402 |
| 4,475,552 | 10/1984 | Yoshihara | 450/107 |
| 4,476,895 | 10/1984 | Shibusawa | 2/401 X |
| 4,612,674 | 9/1986 | Hashimoto | 2/406 |
| 5,081,716 | 1/1992 | Lehenbauer | 2/78 |
| 5,143,092 | 9/1992 | Flowers | 128/875 |

FOREIGN PATENT DOCUMENTS

| | | | |
|---|---|---|---|
| 482452 | 3/1938 | United Kingdom | 2/402 |

*Primary Examiner*—Jeanette E. Chapman
*Attorney, Agent, or Firm*—Anthony R. Lambert

[57] ABSTRACT

A panties is described which includes a shell-form body having a back panel and a generally "T" shaped front panel. The back panel is adapted to substantially cover a ladies buttocks and has a top, a bottom, a first side and a second side. The generally "T" shaped front panel has a front crotch strip and a generally hourglass shaped waist band. The front crotch strip is secured to the bottom of the back panel and is adapted to extend to a top of a pubic bone. The generally hourglass shaped front waist band has a first end secured to the first side of the back panel and a second end secured to the second side of the back panel. The waist band has a symmetrical centre point to which is attached the crotch strip. An elastic extends from where the back panel meets the front crotch strip, up the first side of the back panel, diagonally upwardly across the centre point of the waist band, around the top of the back panel, diagonally downwardly across the centre point of the waist band, down the second side the back panel, and terminates where the back panel meets the front crotch strip.

6 Claims, 4 Drawing Sheets

PANTIES AND A METHOD OF FABRICATING THE SAME

BACKGROUND OF THE INVENTION

Ladies panties are presently constructed using with front and back panels of substantially equal size and three elastics; an elastic around each of the legs and an elastic around the waist area. This design does not effectively maintain the positioning of the panties on the wearer's body. When ladies are involved in activities involving body movement, their panties have a tendency to "ride up" at the back. This garment travel often causes the wearer discomfort.

This problem of garment travel is described in U.S. Pat. 4,121,305 which was issued to Kolker in 1978. The Kolker reference describes how material in the rear rides up over the buttocks and bunches in the crease between the buttocks, and how elastic bands exert pressure upon the leg. The solution proposed by Kolker is an abbreviated form of panties consisting solely of a crotch piece. The crotch piece is maintained in place by means of strategically positioned elastic strings. The form of panties proposed by Kolker have not gained popular acceptance as an alternative form of panties.

SUMMARY OF THE INVENTION

What is required is an alternative method of fabricating ladies panties which will reduce or eliminate garment travel.

According to one aspect of the present invention there is provided a method of fabricating ladies panties, which includes the following steps. Firstly, cut and sew fabric to form a shell-form body having a back panel and a generally "T" shaped front panel. The back panel is adapted to substantially cover a ladies buttocks and has a top, a bottom, a first side and a second side. The generally "T" shaped front panel has a front crotch strip and a generally hourglass shaped front waist band. The front crotch strip is secured to the bottom of the back panel and is adapted to extend to a top of a pubic bone. The generally hourglass shaped front waist band has a first end secured to the first side of the back panel and a second end secured to the second side of the back panel. The waist band has a symmetrical center point to which is attached the crotch strip. Secondly, install an elastic in the shell-form body generally extending from where the back panel meets the front crotch strip, up the first side of the back panel, diagonally upwardly across the center point of the waist band, around the top of the back panel, diagonally downwardly across the center point of the waist band, down the second side of the back panel, and terminating where the back panel meets the front crotch strip.

With the method of fabricating ladies panties, as described, the top of the pubic bone serves as a focal point for the design. The diagonal crossing of the elastic over the focal point helps maintain the back panel in position. Each side is pulled by the elastic passing over the opposing hip. There is no elastic in the crotch piece, as no stretch is needed or wanted there. The panties are anchored by the diagonal crossing over the focal point to reduce garment travel. The crotch strip is limited to the pubic area in order to avoid chaffing in the groin area, even if some garment travel should occur.

According to another aspect of the invention there is provided a panties which includes a shell-form body having a back panel and a generally "T" shaped front panel. The back panel is adapted to substantially cover a ladies buttocks and has a top, a bottom, a first side and a second side. The generally "T" shaped front panel has a front crotch strip and a generally hourglass shaped waist band. The front crotch strip is secured to the bottom of the back panel and is adapted to extend to a top of a pubic bone. The generally hourglass shaped front waist band has a first end secured to the first side of the back panel and a second end secured to the second side of the back panel. The waist band has a symmetrical center point to which is attached the crotch strip. An elastic extends from where the back panel meets the front crotch strip, up the first side of the back panel, diagonally upwardly across the center point of the waist band, around the top of the back panel, diagonally downwardly across the center point of the waist band, down the second side of the back panel, and terminates where the back panel meets the front crotch strip.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
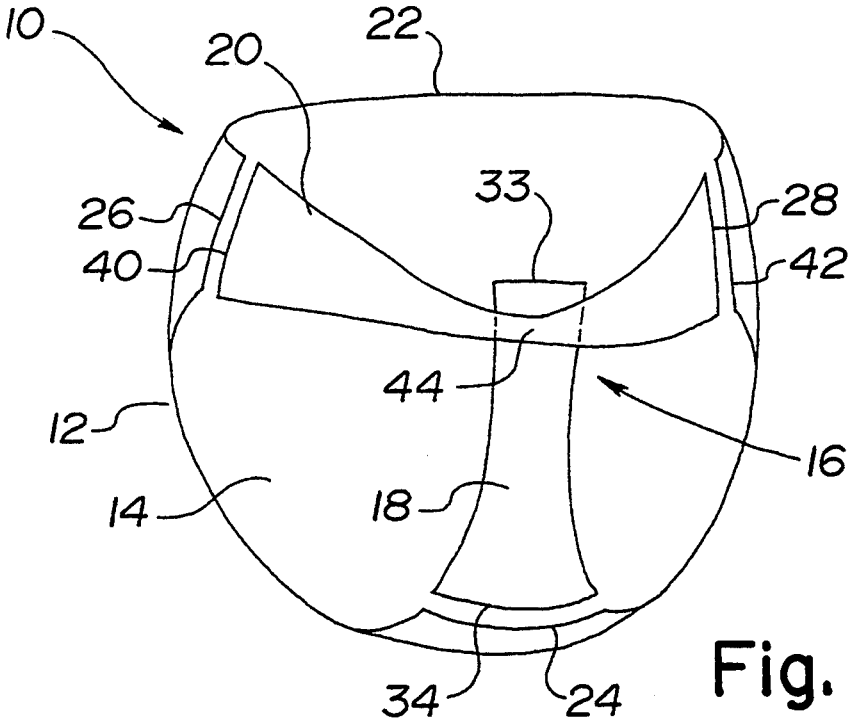
FIG. 1 is an exploded perspective view of panties constructed in accordance with the teachings of the present invention.

The preferred embodiment, a ladies panties generally identified by reference numeral 10, will now be described with reference to FIGS. 1 through 7.

Figure 2:
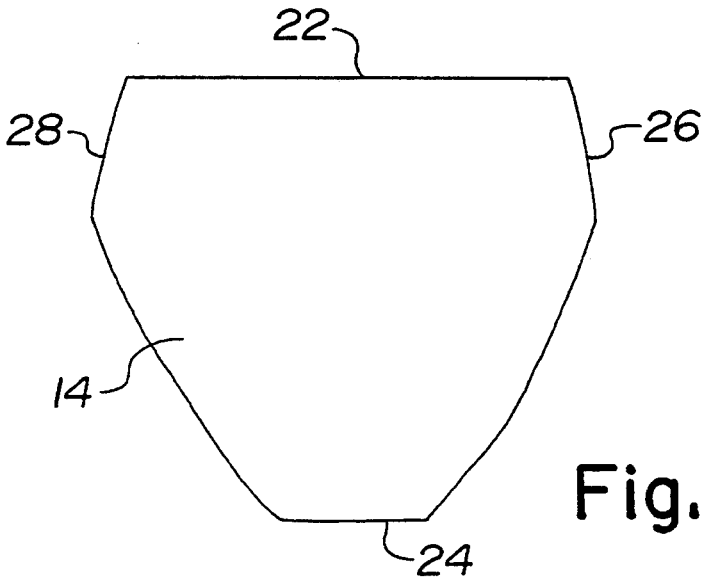
FIG. 2 is a rear elevation view of the panties illustrated in FIG. 1.
Figure 4:
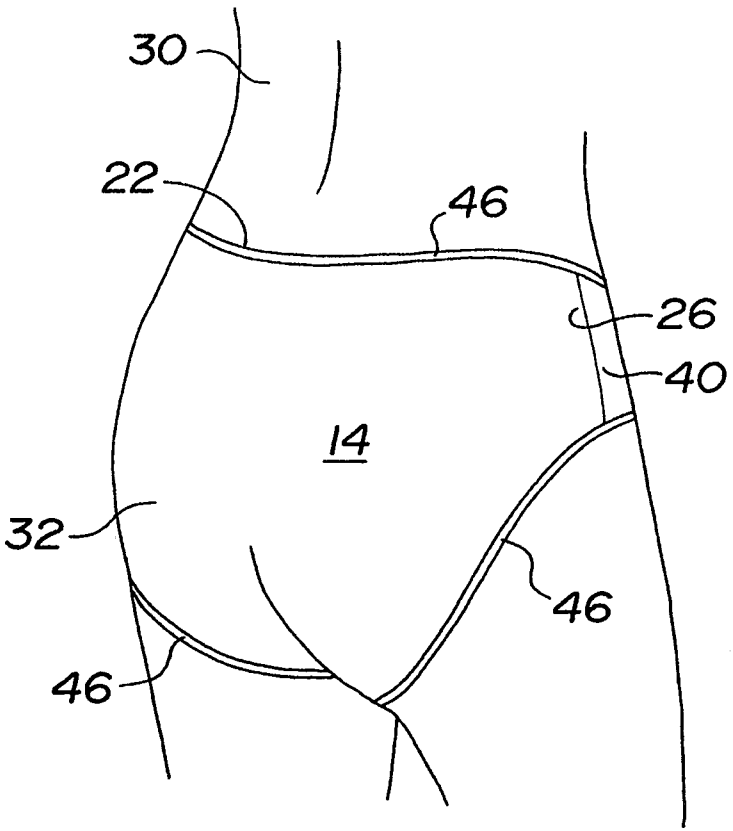
FIG. 4 is a rear elevation view of the lady wearing the panties illustrated in FIG. 3.
Figure 3:
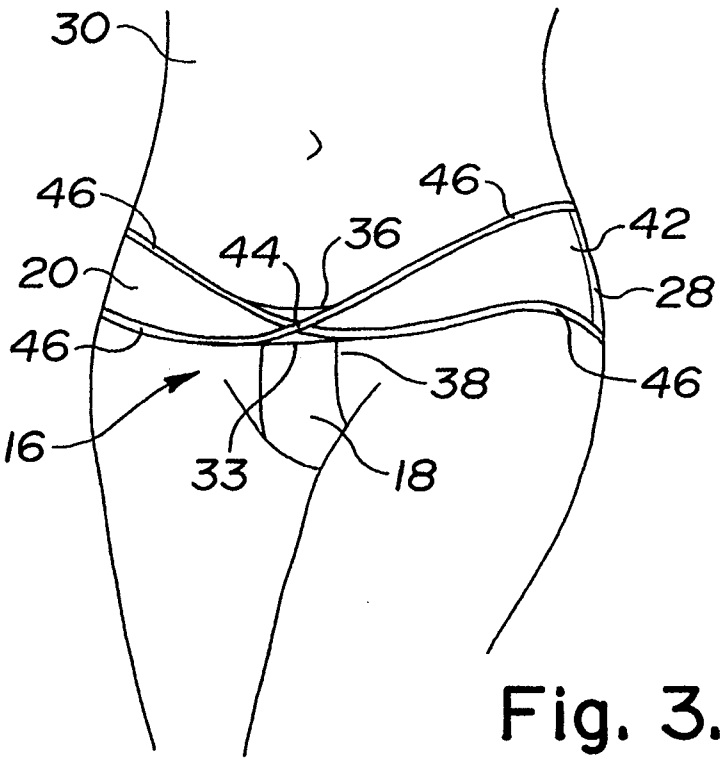
FIG. 3 is a front elevation view of a lady wearing the panties illustrated in FIG. 1.
Figure 6:
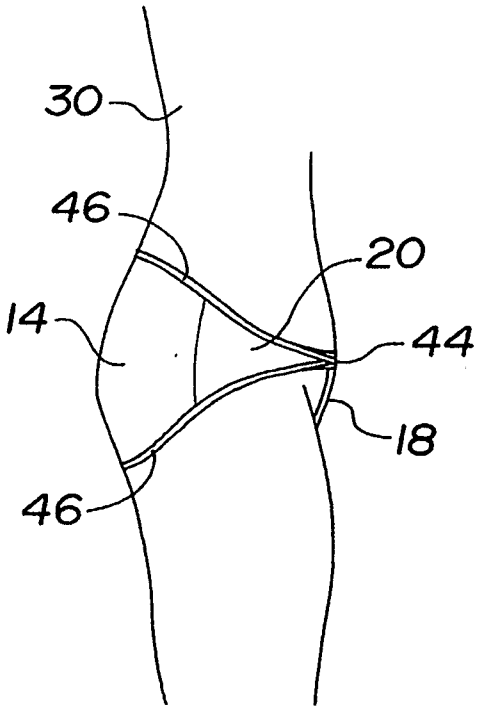
FIG. 6 is a side elevation view of the lady wearing the panties illustrated in FIG. 3.
Figure 5:
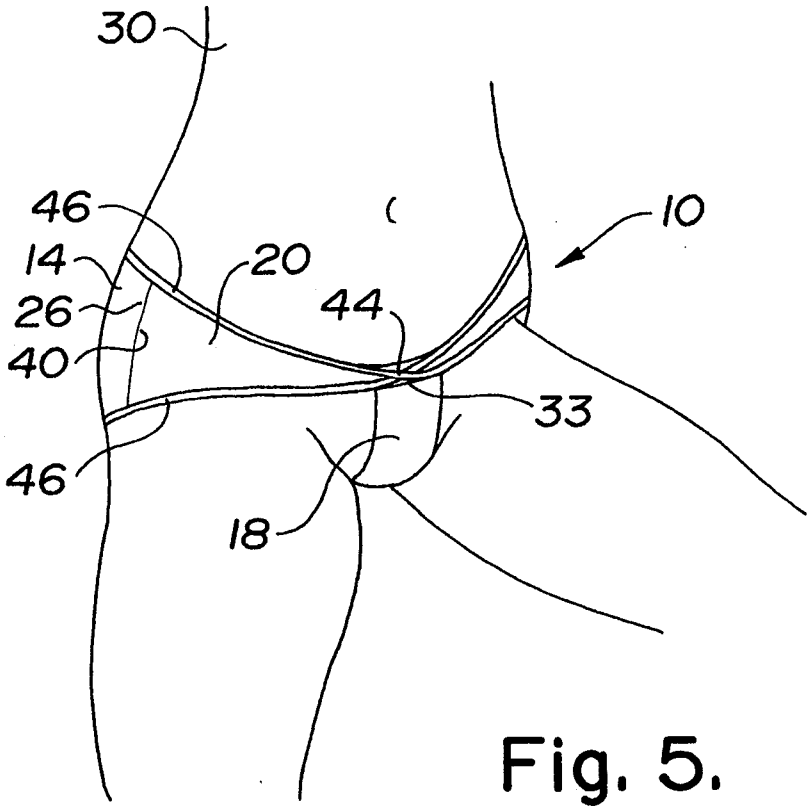
FIG. 5 is a perspective view of the lady wearing the panties illustrated in FIG. 3.

Referring to FIG. 1, panties 10 includes a shell-form body 12. Shell-form body 12 is constructed from a back panel 14, and a generally "T" shaped front panel 16. To facilitate fabrication, front panel 16 is made of two portions; a front crotch strip 18 and a generally hourglass shaped front waist band 20. Referring to Referring to FIG. 2, back panel 14 has a top 22, a bottom 24, a first side 26 and a second side 28. First side 26 and second side 28 are tapered inwardly from adjacent top 22 toward bottom 24. FIGS. 3 through 7, illustrate the manner in which panties 10 are intended to fit when placed on a lady 30. Referring in particular to FIG. 4, it will be apparent that back panel 14 is adapted to substantially cover a buttocks 32 of lady 30. Referring to FIG. 1, front crotch strip 18 has a top end 33 and a bottom end 34. Bottom end 34 is flared. Bottom end 34 of front crotch strip 18 is secured to bottom 24 of back panel 14. Referring to FIGS. 3, 5, and 6, it will be apparent that top end 33 of front crotch strip 18 is adapted to extend to a top 36 of a pubic bone 38 on lady 30. Referring to FIG. 1, generally hourglass shaped front waist band 20 has a first end 40 secured to first side 26 of back panel 14 adjacent top 22, and a second end 42 secured to second side 28 of back panel 14 adjacent top 22. Front waist band 20 has a symmetrical center point 44 to which top end 33 of front crotch strip 18 is attached. Referring to FIG. 2, an elastic 46 extends from bottom 24 where back panel 14 meets bottom end 34 of front crotch strip 18 and up first side 26 of back panel 14. Referring to FIGS. 3 and 4, elastic 46 then extends diagonally upwardly across center point 44 of waist band 20, around top 22 of back panel 14, diagonally downwardly across center point 44 of waist band 20. From there elastic 46 passes down second side 28 of back panel 14, terminating on second side 28 where bottom 24 of back panel 14 meets bottom 34 of front crotch strip 18.

Figure 7:
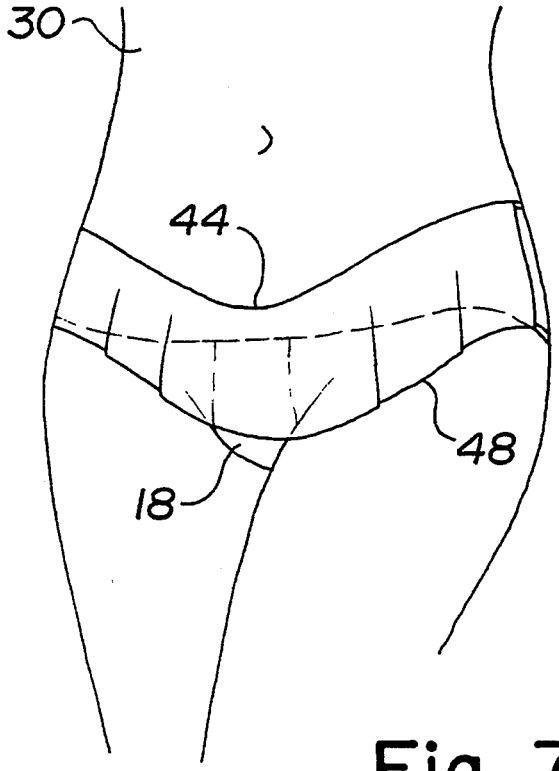
FIG. 7 is a front elevation view of a lady wearing a preferred embodiment of the panties illustrated in FIG. 1.

In order to fabricate panties 10 the following steps are followed. Firstly, cut and sew fabric to formshell-form body 12. Secondly, install elastic 46 in shell-form body 12, as described. In order to aesthetically complete panties 10 a skirt 48 may be attached to waist band 20, as illustrated in FIG. 7.

Center point 44 serves as a focal point for panties 10. Center point 44 is strategically placed at top 36 of pubic bone 38. When walking, bending, twisting or sitting center point 44 remains stationary. By "anchoring" panties 10 at center point 44 garment travel is reduced. The material in the area of the legs is restricted to front crotch strip 18. Contact between panties 10 and the wearer's legs which caused discomfort in the prior art is eliminated. Front crotch strip 18 does not extend far enough to dig into the leg or possibly interfere with the tendon that joins the interior of the leg to the body. In addition, there is no elastic on front crotch strip 18 as no stretch is wanted or needed in this area. The elastic is uniquely positioned with a diagonal crossing over center point 44. The diagonal crossing helps keep back panel 14 in place with a gentle pull over the hip and under buttocks 32. The point of stress is at center point 44, which is a very small area. Hourglass shaped front waist band 20 acts like a belt, as it adopts a position tucking under a natural tummy bulge and along a fold line of the hip joints.

It will be apparent to one skilled in the art that modifications may be made to the illustrated embodiment without departing from the spirit and scope of the invention as defined by the Claims.

The embodiments of the invention in which an exclusive property or privilege is claimed are as follows:

1. A panties comprised of:

a shell-form body having:

i. a back panel adapted to substantially cover a ladies buttocks, the back panel having a top, a bottom, a first side and a second side;

ii. a generally "T" shaped front panel consisting solely of:

a front waist band having a first end secured to the first side of the back panel and a second end secured to the second side of the back panel; and a front crotch strip secured between the bottom of the back panel and a symmetrical center point of the front waist band unencumbered by elastic or connecting fabric webbing;

b. elastic generally extending from where the back panel meets the front crotch strip, up the first side of the back panel, diagonally upwardly across the center point of the waist band, around the top of the back panel, diagonally downwardly across the center point of the waist band, down the second side of the back panel, and terminating where the back panel meets the front crotch strip.

2. The panties as defined in claim 1, the first side and the second side of the back panel being tapered inwardly from the top toward the bottom.

3. The panties as defined in claim 1, the front crotch strip being flared where the front crotch strip is attached to the bottom of the back panel.

4. The panties as defined in claim 1, having a skirt depending from the waist band.

5. The panties as defined in claim 1, wherein the front waist band is flared from the symmetrical center point outwardly toward the first end and the second end, thereby defining a generally planar hourglass shape.

6. A panties, comprising of:

a. a shell-form body having:

i. a back panel adapted to substantially cover a ladies buttocks, the back panel having a top, a bottom, a first side and a second side, the first side and the second side of the back panel being tapered inwardly from the top toward the bottom;

ii. a generally "T" shaped front panel consisting solely of:

a front waist band having a first end secured to the first side of the back panel and a second end secured to the second side of the back panel; and a front crotch strip secured between the bottom of the back panel and a symmetrical center point of the front waist band unencumbered by elastic or connecting fabric webbing, the front crotch strip being flared where the front crotch strip is attached to the bottom of the back panel;

the front waist band is flared from the symmetrical center point outwardly toward the first end and the second end, thereby defining a generally planar hourglass shape; and b. elastic generally extending from where the back panel meets the front crotch strip, up the first side of the back panel, diagonally upwardly across the center point of the waist band, around the top of the back panel, diagonally downwardly across the center point of the waist band, down the second side of the back panel, and terminating where the back panel meets the front crotch strip.

* * * * *